US006374930B1

(12) United States Patent
Singh et al.

(10) Patent No.: US 6,374,930 B1
(45) Date of Patent: Apr. 23, 2002

(54) CUTTING STRUCTURE FOR ROLLER CONE DRILL BITS

(75) Inventors: Amardeep Singh, Houston; Sujian Huang, The Woodlands, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/590,580

(22) Filed: Jun. 8, 2000

(51) Int. Cl.[7] ..... E21B 10/16
(52) U.S. Cl. ..... 175/374; 175/426; 175/376
(58) Field of Search ..... 175/374, 426, 175/376

(56) References Cited

U.S. PATENT DOCUMENTS

| | | | | | |
|---|---|---|---|---|---|
| 2,496,421 | A | * | 2/1950 | Stokes | 175/374 |
| 4,408,671 | A | | 10/1983 | Munson | 175/377 |
| 4,420,050 | A | * | 12/1983 | Jones | 175/374 |
| 4,427,081 | A | | 1/1984 | Crawford | 175/376 |
| 4,611,673 | A | | 9/1986 | Childers et al. | 175/340 |
| 4,657,093 | A | | 4/1987 | Schumacher | 175/353 |
| 4,848,476 | A | | 7/1989 | Dean et al. | 175/340 |
| 5,224,560 | A | * | 7/1993 | Fernandez et al. | 175/374 |
| 5,372,210 | A | | 12/1994 | Harrell | 175/431 |
| 5,394,952 | A | | 3/1995 | Johns et al. | 175/332 |
| 5,421,423 | A | * | 6/1995 | Huffstutler | 175/374 |
| 5,715,899 | A | * | 2/1998 | Liang et al. | 175/374 |
| 5,813,480 | A | | 9/1998 | Zaleski, Jr. et al. | 175/40 |
| 6,057,784 | A | | 5/2000 | Schaaf et al. | 340/854.4 |
| 6,095,262 | A | * | 8/2000 | Chen | 175/57 |

FOREIGN PATENT DOCUMENTS

| | | |
|---|---|---|
| EP | 0 511 547 A2 | 11/1992 |
| GB | 2 343 905 A | 5/2000 |
| WO | WO 00/12859 | 3/2000 |
| WO | WO 00/12860 | 3/2000 |

OTHER PUBLICATIONS

Great Britain Search Report dated Aug. 15, 2001, 1 page.

* cited by examiner

*Primary Examiner*—Hoang Dang
(74) *Attorney, Agent, or Firm*—Rosenthal & Osha LLP

(57) ABSTRACT

The invention is directed to a roller cone drill for drilling earth formations. The drill bit includes a bit body and a plurality of roller cones attached to the bit body and able to rotate with respect to the bit body. The drill bit further includes a plurality of teeth disposed on each of the roller cones such that the number of teeth on each cone differs by two or fewer from the number of teeth on each of the other cones. In one preferred embodiment, the drill bit includes three roller cones. In another preferred embodiment, the teeth of the bit are arranged on each cone so that teeth on adjacent cones intermesh between the cones. In another preferred embodiment, the drill bit includes a first cone, a second cone, and a third cone, and the number of teeth on each of the cones is 17, 16, and 18, respectively.

7 Claims, 8 Drawing Sheets

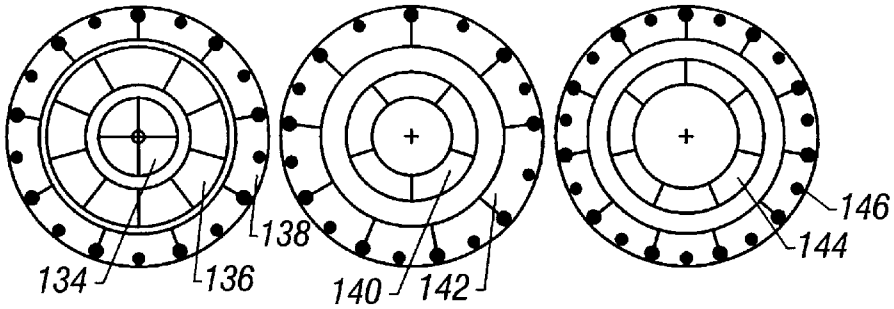

| | CONE | ROW | # TEETH | SPACING | INCLINATION ANGLE | TOOTH ANGLE | TOOTH WIDTH INNER END ② | TOOTH WIDTH OUTER END 3 | ROOT ANGLE | END MILL CUTTER ANGLE | END MILL CUTTER RADIUS | SPECIAL INSTRUCTIONS |
|---|---|---|---|---|---|---|---|---|---|---|---|---|
| 120 | | A | 4 | 4 | 19.49° | 40.00° | .06 | .06 | 16.69° | 120.00° | .125 R | SEE DIAGRAM FOR ORIENTATION |
| 122 | 1 | B | 9 | 19 | 31.89° | 43.00° | .09 | .09 | 18.33° | 75.00° | .250 R | ONE 1-1/2 P (SEE DIAGRAM FOR PLACEMENT) |
| 124 | | C | 9 | 18 | 11.99° | 43.00° | .14 | .14 | 10.53° | 62.50° | .125 R | DELETE EVERY OTHER TOOTH WITH 45° x .750 ED x .250 R CUTTER • 15.0° ROOT. MILL AXIS ⊥ TO TOOTH ROOT. STOP CUTTER PRIOR TO CONTACTING TEETH ON "B" ROW. |
| 126 | | A | 5 | 5 | 24.69° | 43.00° | .09 | .09 | 19.50° | 105.00° | .125 R | SEE DIAGRAM FOR ORIENTATION |
| 128 | 2 | B | 9 | 30 | 17.46° | 43.00° | .09 | .15 | 13.39° | 77.50° | .625 R / .375 R | THREE 1-1/3 P (SEE DIAGRAM FOR PLACEMENT) MILL FIRST PASS COMPLETELY THRU WITH .625 R CUTTER. MILL SECOND PASS WITH .375 R CUTTER AND STOP CUTTER PER PRINT. BLEND CUTS AS CLOSE AS POSSIBLE. |
| 130 | | A | 7 | 7 | 32.20° | 43.00° | .09 | .09 | 22.85° | 85.00° | .375 R | SEE DIAGRAM FOR ORIENTATION |
| 132 | 3 | B | 11 | 11 | 11.21° | 43.00° | .12 | .12 | 8.96° | 75.00° | .563 R / .250 R | MILL FIRST PASS COMPLETELY THRU WITH .563 R CUTTER. MILL SECOND PASS WITH .250 R CUTTER AND STOP CUTTER PER PRINT. BLEND CUTS AS CLOSE AS POSSIBLE. |

*FIG. 3C*
*(Prior Art)*

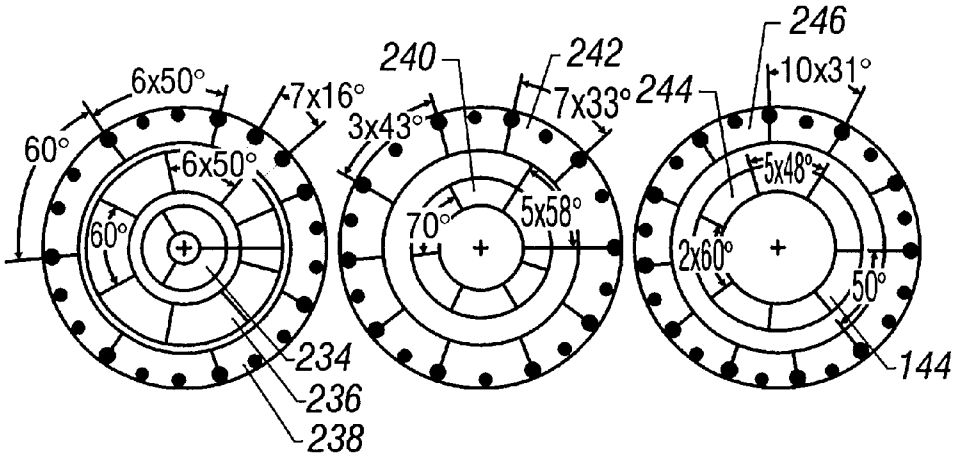

| CONE | ROW | # TEETH | PITCH SPACING | TOOTH ANGLE | TOOTH WIDTH INNER END ② | TOOTH WIDTH OUTER END ③ | ROOT ANGLE | RADIUS | SPECIAL INSTRUCTIONS |
|---|---|---|---|---|---|---|---|---|---|
| | A | 3 | 3x120° | 43.00° | .09 | .09 | 16.69° | .125 R | SEE DIAGRAM FOR ORIENTATION |
| 1 | B | 7 | 6x50°;1x60° | 43.00° | .09 | .09 | 18.33° | .250 R | SEE DIAGRAM FOR ORIENTATION |
| | C | 7 | 6x50°;1x60° | 43.00° | .12 | .12 | 10.53° | .250 R | SEE DIAGRAM FOR ORIENTATION |
| | A | 6 | 5x58°;1x70° | 43.00° | .14 | .14 | 19.50° | .125 R | SEE DIAGRAM FOR ORIENTATION |
| 2 | B | 10 | 7x33°;3x43° | 43.00° | .12 | .12 | 13.39° | .188 R | SEE DIAGRAM FOR ORIENTATION |
| | A | 7 | 5x48°;2x60° | 43.00° | .09 | .09 | 22.85° | .188 R | SEE DIAGRAM FOR ORIENTATION |
| 3 | B | 11 | 10x31°;1x50° | 43.00° | .12 | .12 | 8.96° | .125 R | SEE DIAGRAM FOR ORIENTATION |

220 222 224 226 228 230 232

FIG. 6

CUTTING STRUCTURE FOR ROLLER CONE DRILL BITS

BACKGROUND OF THE INVENTION

1. Technical Field

The invention relates generally to roller cone drill bits for drilling earth formations, and more specifically to roller cone drill bit designs.

2. Background Art

Roller cone rock bits and fixed cutter bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a well bore 14. Connected to the end of the drill string 12 is roller cone-type drill bit 20, shown in further detail in FIG. 2.

Roller cone bits 20 typically comprise a bit body 22 having an externally threaded connection at one end 24, and a plurality of roller cones 26 (usually three as shown) attached at the other end of the bit body 22 and able to rotate with respect to the bit body 22. Disposed on each of the cones 26 of the bit 20 are a plurality of cutting elements 28 typically arranged in rows about the surface of the cones 26. The cutting elements 28 may comprise tungsten carbide inserts, polycrystalline diamond compacts, or milled steel teeth.

Significant expense is involved in the design and manufacture of drill bits to produce drill bits with increased drilling efficiency and longevity. For more simple bit designs, such as fixed cutter bits, models have been developed and used to design and analyze bit configurations having optimally placed cutting elements, a more balanced distribution of force on the bit, and a more balanced distribution of wear on the cone. These force-balanced bits have been shown to be long lasting and effective in drilling earth formations.

Roller cone bits are more complex in design than fixed cutter bits, in that the cutting surfaces of the bit are disposed on roller cones. Each of the roller cones independently rotates relative to the rotation of the bit body about an axis oblique to the axis of the bit body. Because the roller cones rotate independent of each other, the rotational speed of each cone is likely different. For a given cone, the cone rotation speed can be determined from the rotational speed of the bit and the effective radius of the "drive row" of the cone. The effective radius of a cone is generally related to the radial extent of the cutting elements that extend axially the farthest from the axis of rotation of the cone. The cutting elements which extend axially the farthest from the axis of rotation of the cone are generally located on a so-called "drive row". In some configurations, the cutting elements on the drive row are located to drill the fall diameter of the bit. In such cases, the drive row may be interchangeably referred to as the "gage row".

Adding to the complexity of roller cone bit designs, cutting elements disposed on the cones of the roller cone bit deform the earth formation by a combination of compressive fracturing and shearing. Additionally, most modem roller cone bit designs have cutting elements arranged on each cone so that cutting elements on adjacent cones intermesh between the adjacent cones, as shown for example in FIG. 3A and further detailed in U.S. Pat. No. 5,372,210 to Harrell. Intermeshing cutting elements on roller cone drill bits is desired to permit high insert protrusion to achieve competitive rates of penetration while preserving the longevity of the bit. However, intermeshing cutting elements on roller cone bits substantially constrains cutting element layout on the bit, thereby, further complicating the designing of roller cone drill bits.

Because of the complexity of roller cone bit designs, accurate models of roller cone bits have not been widely developed or used to design roller cone bits. Instead, roller cone bits have been largely developed through trial and error. For example, if its been shown that a prior art bit design leads to cutting elements on one cone of a bit being worn down faster that the cutting elements on another cone of the bit, a new bit design might be developed by simply adding more cutting elements to the faster worn cone in hopes of reducing wear on each of the cutting elements on that cone. This trial and error method of designing roller cone drill bits has led to roller cone bits with cutting elements unequally distributed between the cones, wherein the number of cutting elements on one cone of the bit differs by three or more from the number of cutting elements on another cone of the bit. In some cases, especially those involving cutting structures comprising intermeshing teeth, the difference between the number of cutting elements on each cone is significantly more than three. In some prior art bit designs, the unequal distribution of the number of cutting elements between the cones may result in an unequal distribution of force, strain, stress, and wear between the cones, which can lead to the premature failure of one of the cones. In other prior art bit designs, the unequal distribution of the number of cutting elements between the cones may result in an unequal distribution of contact with the formation between the cones or an unequal distribution of volume of formation cut between the cones.

One example of a prior art roller cone bit configuration considered effective in drilling well bores is shown in FIGS. 3A–3D. In FIG. 3A, the profiles of each of the cutting elements on each cone are shown in relation to each other to show the intermeshing of the cutting elements between adjacent cones. This drill bit comprises a bit body 100 and three roller cones 110 attached to the bit body 100 such that each roller cone 110 is able to rotate with respect to the bit body 100 about an axis oblique to the bit body 100. Disposed on each of the cones 110 is a plurality of cutting elements 112 for cutting into an earth formation. The cutting elements are arranged about the surface of each cone in generally circular, concentric rows arranged substantially perpendicular to the axis of rotation of the cone, as illustrated in FIG. 3C. In this example, the rows of cutting elements are arranged so that cutting elements on adjacent cones intermesh between the cones. In this example, the cutting elements 112 comprise milled steel teeth with hardface coating applied thereon.

As is typical for milled tooth roller cone bits with intermeshing teeth, the teeth in this example are arranged in three rows 114*a*, 114*b*, and 114*c* on the first cone 114, two rows 116*a* and 116*b* on the second cone 116, and two rows 118*a* and 118*b* on the third cone 118. The first row 114*a* on the first cone 114 is located at the apex of the cone and is typically referred to as the spearpoint. Referring to FIG. 3C, the first row 114*a* of the first cone comprises four teeth spaced about the apex of the cone as shown in the table at 120 and illustrated in the spacing diagram at 134. The second row 114*b* on the first cone 114 comprises nine teeth spaced apart as shown in the table at 122 and illustrated in the spacing diagram at 136. The third row 114*c* on the first cone 114 comprises nine teeth spaced apart as shown in the table at 124 and illustrated in spacing diagram at 138. The first row 116*a* on the second cone 116 comprises five teeth spaced apart as shown in the table at 126 and illustrated in the spacing diagram at 140. The second row 116*b* on the second cone 116 comprises nine teeth spaced apart as shown in the table at 128 and illustrated in the spacing diagram at 142. The first row 118*a* on the third cone 118 comprises seven teeth spaced apart as shown at 126 and illustrated in the spacing diagram at 144. The second row 118*b* on the third cone 118 comprises eleven teeth spaced apart as shown at 128 and illustrated in the spacing diagram at 146.

This prior art drill bit has a total of fifty-four teeth, wherein twenty-two teeth are disposed on the first cone, fourteen teeth are disposed on the second cone, and eighteen teeth are disposed on the third cone. The greatest difference in the number of teeth on any two cones for this prior art bit is eight. Thus the distribution of the teeth on this bit is significantly imbalanced, as is typical for prior art roller cone bit designs.

BRIEF SUMMARY OF THE INVENTION

The invention comprises a roller cone drill for drilling earth formations. The drill bit comprises a bit body and a plurality of roller cones attached to the bit body and able to rotate with respect to the bit body. The drill bit further comprises a plurality of teeth disposed on each of the roller cones such that the number of teeth on each cone differs by two or fewer from the number of teeth on each of the other cones. In one preferred embodiment, the drill bit comprises three roller cones. In another preferred embodiment, the teeth of the bit are arranged on each cone so that teeth on adjacent cones intermesh between the cones. In another preferred embodiment, the drill bit comprises a first cone, a second cone, and a third cone, and the number of teeth on each of the cones is 17, 16, and 18, respectively.

BRIEF DESCRIPTION OF THE DRAWINGS

FIG. 3C is a spacing diagram for a prior art bit.

FIG. 6 is a spacing diagram for a drill bit in accordance with one embodiment of the invention.

DETAILED DESCRIPTION

Figure 4:
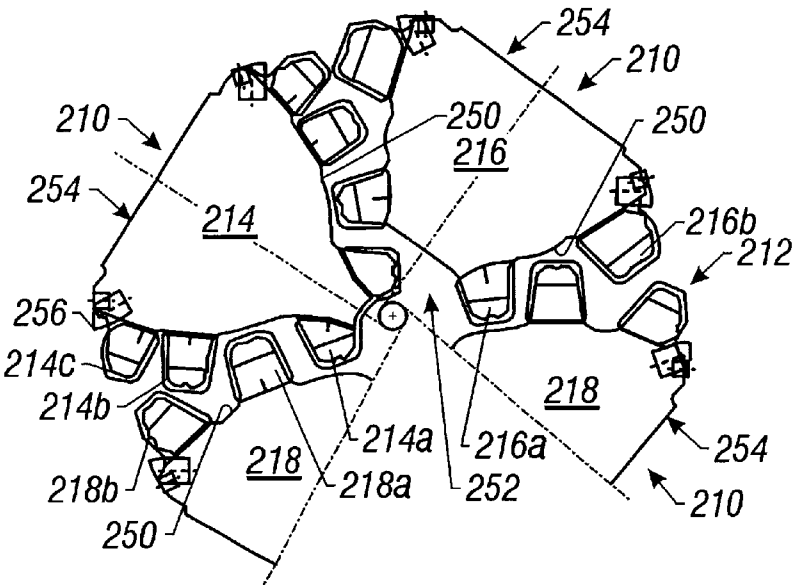
FIG. 4 is a diagram of the roller cones for a bit in accordance with one embodiment of the invention illustrating an intermeshing relationship of the cutting elements between the cones.
Figure 7:
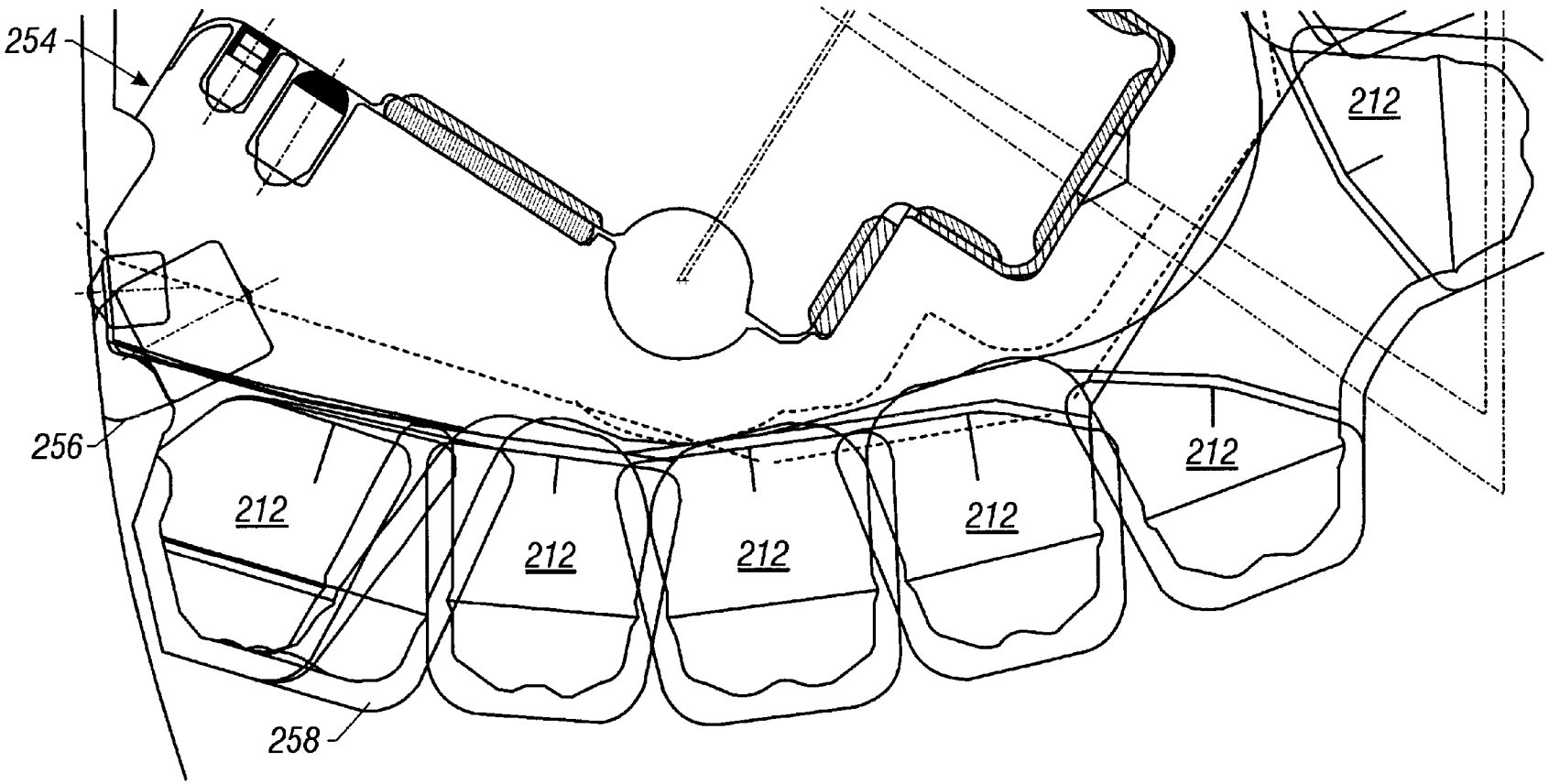
FIG. 7 is an enlarged partial view of the cone and cutting elements for an embodiment of the invention as shown in FIG. 5.

Referring to FIGS. 4–7, in one embodiment, the invention comprises a roller cone bit which includes a bit body 200 (partial view in FIG. 5) and a plurality of roller cones (typically three), collectively referenced as 210 in FIG. 4. Each of the roller cones 210 are attached to the bit body 200 and able to rotate with respect to the bit body 200. In this embodiment, the cones 210 of the bit include a first cone 214, a second cone 216, and a third cone 218. Each cone 210 includes an exterior surface, generally conical in shape and having a side surface 250. Disposed about the side surface 250 of each of the cones 210 is a plurality of cutting elements, shown generally at 212 and additionally shown at 256. A distinction between cutting elements 212 and cutting elements 256 will be further explained.

In this embodiment, the plurality of cutting elements disposed on each cone are arranged primarily on the side surface 250 of each cone 214, 216, 218, as shown in FIG. 4. In general, at least three different types of cutting elements may be disposed on the cones, including primary cutting elements, generally indicated as 212, gage cutting elements, generally indicated as 256 and ridge cutting elements (not shown). In the embodiment of FIG. 4, primary cutting elements 212 are the cutting elements generally arranged about the conical surface 250 of the cones and used as the primary means for cutting through the bottomhole surface of the earth formation. Gage cutting elements 256 are cutting elements which scrape the wall of the well bore to maintain the diameter of the well bore. Gage cutting elements 256 are typically arranged in one or more rows about the lower edge of one or more cones as shown at 256 in FIGS. 4, 5, and 7. Rows of gage cutting elements are typically referred to as "gage rows", "heel rows" or "trucut" rows. Ridge cutting elements (not shown) are miniature cutting elements, or hardened material deposits that are, optionally, disposed about the surface of the cone, typically between the primary cutting elements 212, to protect the cone surface and cut formation ridges which pass between cutting elements on the cones. Ridge cutting elements are used to reduce damage or wear of the cone surface by reducing contact between the cone surface and formation ridges.

It should be understood that in another embodiment, the cutting elements may comprise only primary cutting elements 212, or primary cutting elements 212 and, optionally, gage 256, and/or ridge cutting elements. Further, while primary cutting elements 212 and gage cutting elements 256 are shown as distinctly different sets of cutting elements for this embodiment, it should be understood that in other embodiments, one or more primary cutting elements 212 may be arranged on one or more cones to essentially perform as a gage cutting element. The types and combinations of cutting elements used is a matter of choice for the bit designer and are not intended as a limitation on the invention.

FIG. 4 shows the cone and cutting element configurations for this embodiment of the invention illustrating the location of the primary cutting elements 212 on each cone. In this embodiment, the primary cutting elements 212 are arranged on each cone so that primary cutting elements 212 on adjacent cones form an intermeshing cutting element pattern between the cones, as shown in FIG. 4. The primary cutting elements in this embodiment, comprise milled steel teeth. These teeth 212 are generally arranged in circular, concentric rows about the conical side surface 250 of each cone, as shown in FIGS. 4 and 6. On the first cone 214 the teeth 212 are arranged in three rows 214*a*, 214*b* and 214*c*. On the second cone 216 the teeth 212 are arranged in two rows 216*a* and 216*b*. On the third cone 218 the teeth 212 are arranged in two rows, 218*a* and 218*b*.

FIG. 6 illustrates the preferred arrangement of the teeth 212 on the cones for this embodiment of the invention. According to the spacing diagrams and corresponding table in FIG. 6, the teeth 212 are disposed on the cones such that the first cone 214 has seventeen teeth disposed on its side surface 250, the second cone 216 has sixteen teeth disposed on its side surface 250, and the third cone 218 has eighteen teeth disposed on its side surface 250. The teeth on the first cone 214 are arranged such that the first row 214*a* contains three teeth spaced apart about the side surface 250 of the cone as shown in the table at 220 and in the diagram at 234. The second and third rows 214*b*, 214*c* on the first cone 214 contain seven teeth each, as shown in the table at 222, 223 and in the diagram at 236 and 238, respectively. The teeth on the second cone 216 are arranged such that the first row 216*a* contains six teeth spaced apart about the side surface 250 of the cone as shown in the table at 226 and in the diagram at 240. The second row 216*b* of second cone 216 contains ten teeth spaced apart about the side surface 250 of the second cone as shown in the table at 228 and in the diagram at 242. The teeth on the third cone 218 are arranged such that the first row 218*a* contains seven teeth spaced apart about the side surface 250 of the third cone 218 as shown in the table at 230 and in the diagram at 244. The second row 218*b* of the third cone 218 contains eleven teeth spaced apart about the side surface 250 of the third cone 218 as shown in the table at 232 and in the diagram at 246. In this embodiment, the tooth angle for each of the teeth on each cone is shown in the table of FIG. 6 to be approximately 43 degrees. However, tooth angles and pitch spacing of the teeth on the cone are matters of choice for the bit designer and are not intended as limitations on the invention.

In this embodiment, the primary cutting elements 212, as previously explained, comprise milled steel teeth formed on the cones. Hardface coating 258 is applied to the teeth (shown in more detail in FIG. 7) to produce a tooth cutting structure with increased hardness. In alternative embodiments, the teeth may comprise milled steel teeth without hardface coating applied thereon.

It should be understood that the tooth counts shown in FIG. 6 and discussed above, are directed to the number of primary cutting elements 212 disposed on each of the cones to cut through the bottomhole surface of the well bore. The number and arrangement of gage cutting elements and the use of ridge cutting elements are matters of choice for the bit designer, and are not limitations on the invention.

Figure 1:
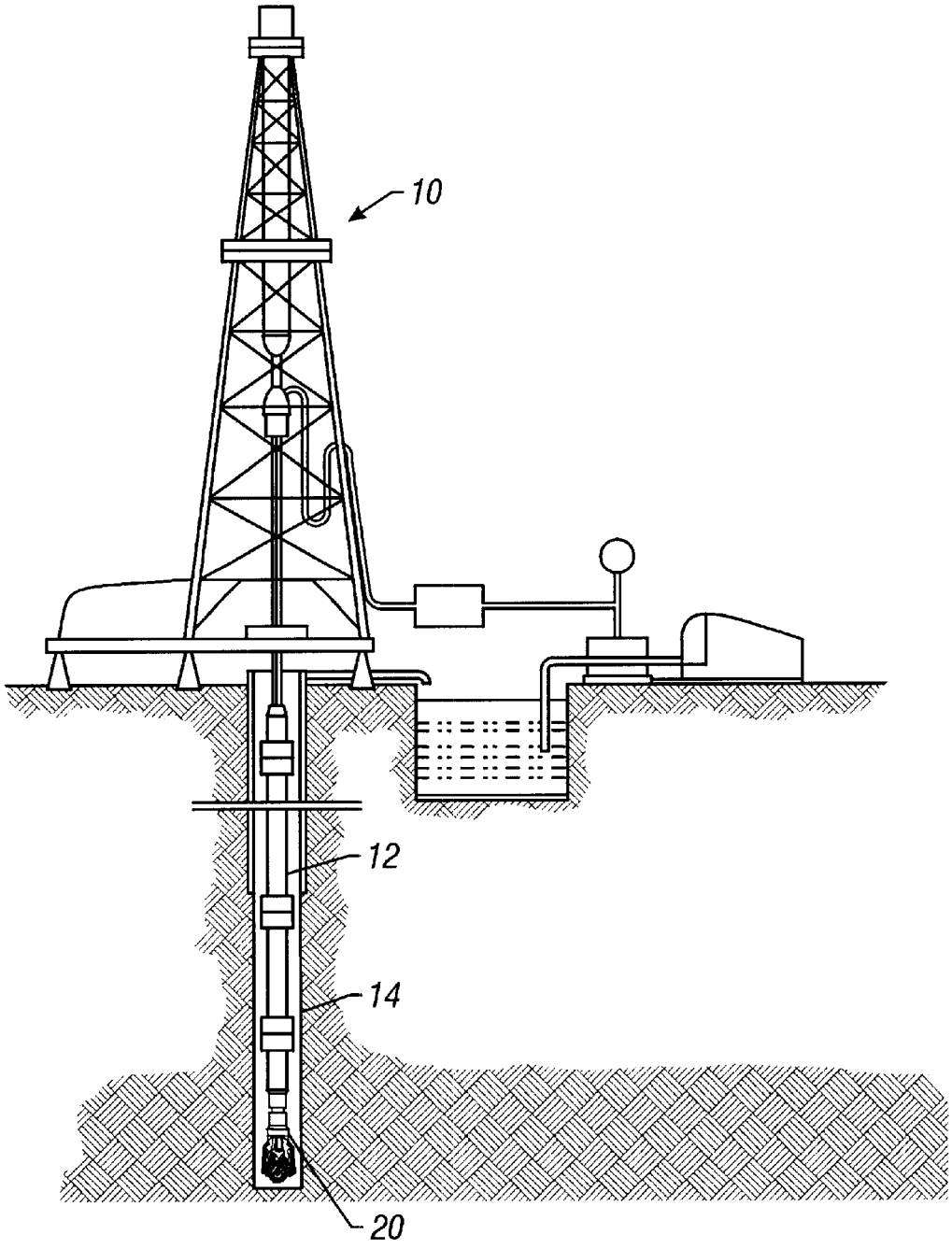
FIG. 1 (Prior Art)
FIG. 1 shows a schematic diagram of a drilling system for drilling earth formations.
Figure 2:
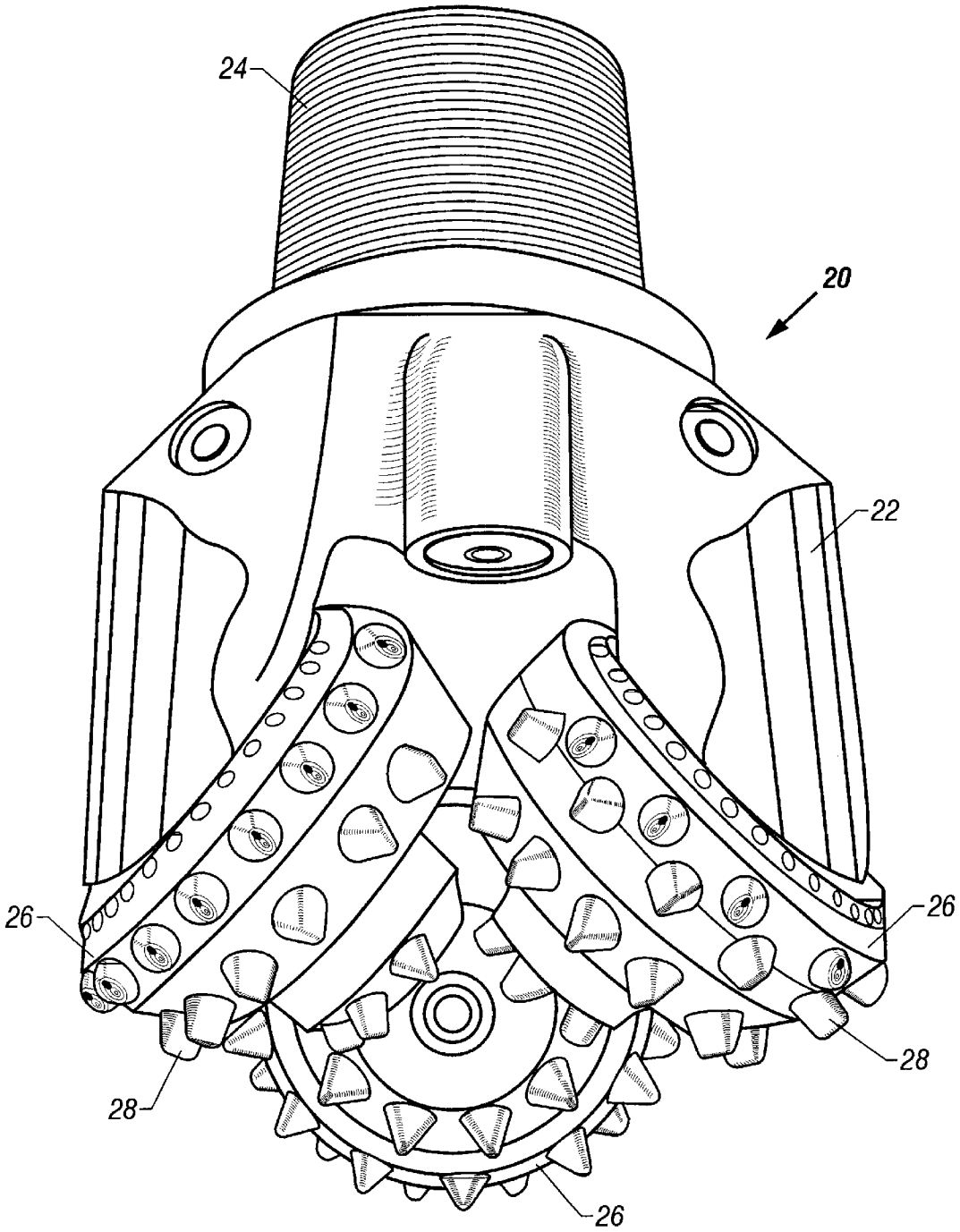
FIG. 2 (Prior Art)
FIG. 2 shows a perspective view of a prior art roller cone drill bit.
Figure 3B:
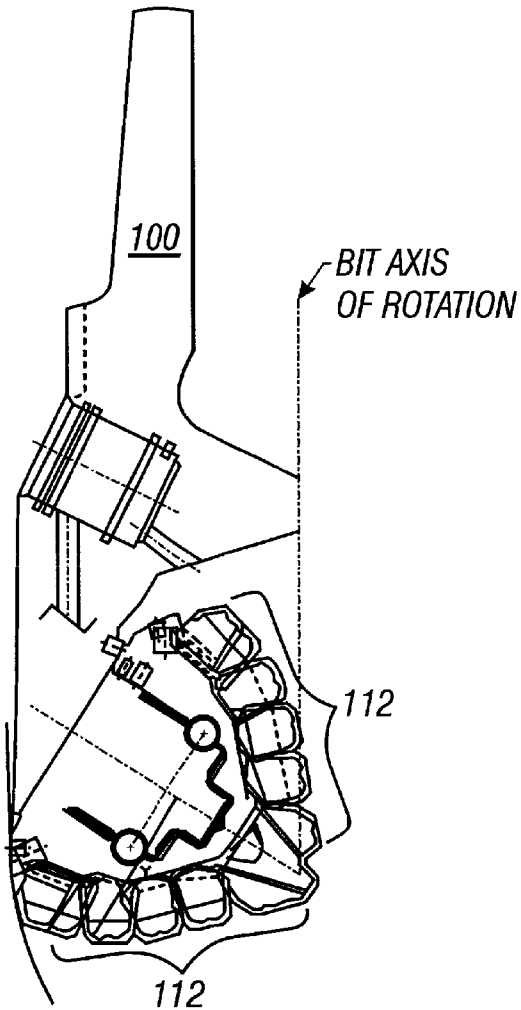
FIG. 3B (Prior Art)
FIG. 3B is a schematic diagram of one leg of a prior art bit wherein the effective position of cutting elements on all three cones of the bit are illustrated on the cone shown to illustrate bottomhole coverage of the bit.
Figure 3A:
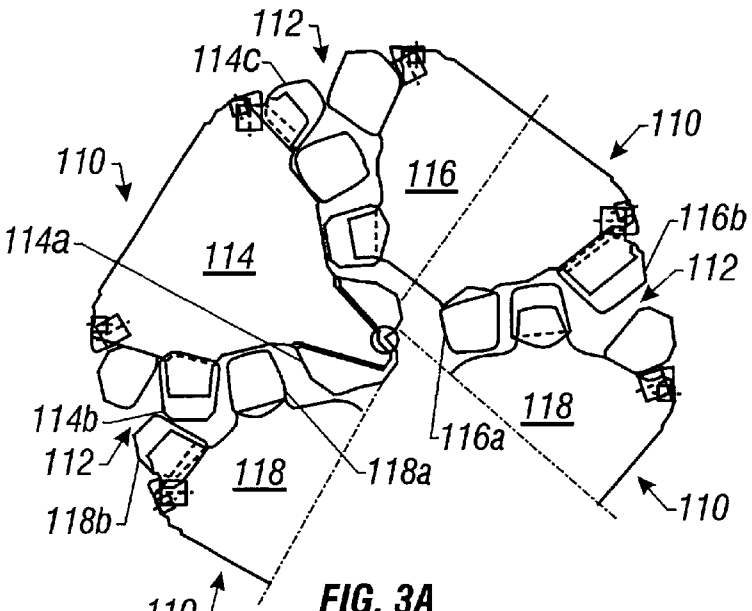
FIG. 3A (Prior Art)
FIG. 3A is a diagram of the roller cones of a prior art drill bit illustrating the intermeshing relationship of the cutting elements between the cones.
Figure 3D:
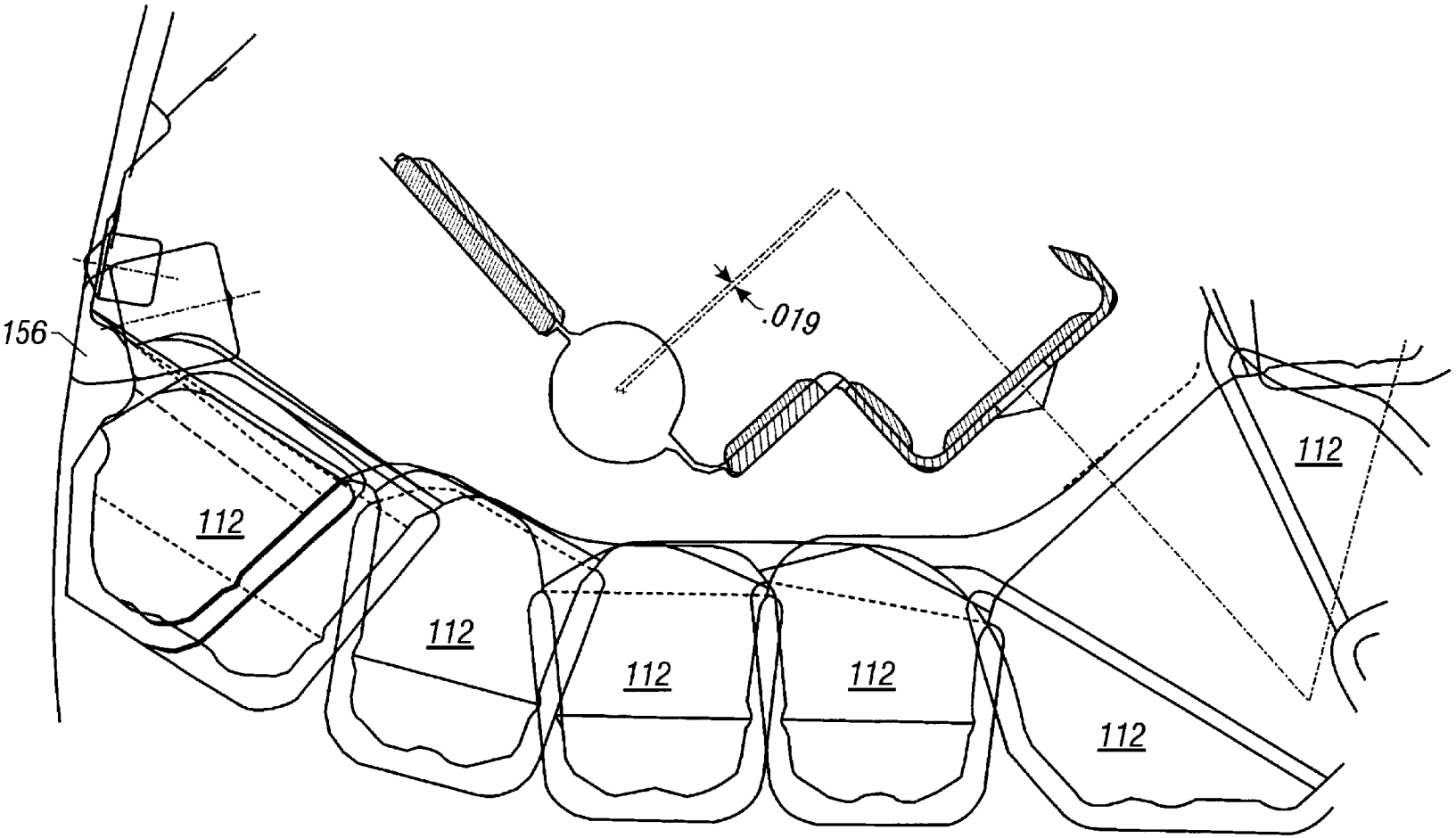
FIG. 3D is an enlarged partial view of the cone and cutting elements of the prior art bit shown in FIG. 3B.
Figure 5:
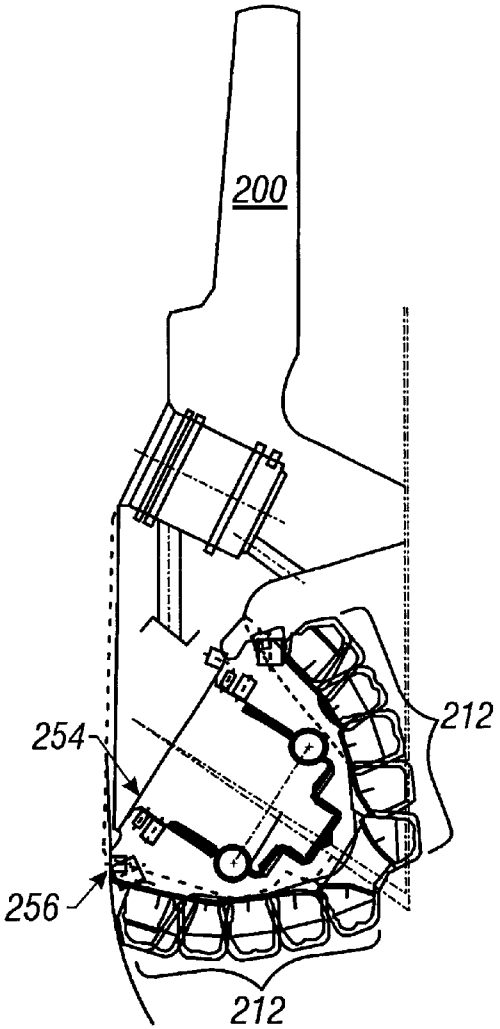
FIG. 5 is a schematic diagram of one leg of a drill bit configured in accordance with one embodiment of the present invention, wherein the effective position of cutting elements on all three cones of the bit are illustrated on the cone shown to illustrate bottomhole coverage of the bit.

Advantageously, this embodiment exhibits a more equalized distribution of teeth between the cones. Prior art bits have had differences of three or more teeth between cones, in that the difference in the number of teeth between the cone with the highest tooth count and the cone with the lowest tooth count has been three or more. For example, the prior art bit in FIG. 3 has twenty-two teeth on the first cone, fourteen teeth on the second cone, and eighteen teeth on the third cone. Thus, the difference in the number of teeth on two of the cones is eight. However, embodiments of the present invention have teeth disposed on each of the roller cones such that the difference between the number of teeth on any two of the cones is two or fewer. The embodiment of the invention shown in FIGS. 4–7 has a greatest tooth difference between any two cones of only two. Thus, this embodiment, advantageously, provides a roller cone drill bit with teeth that intermesh between adjacent cones while providing a more balanced distribution of teeth between the cones.

In this embodiment, the teeth are shown as arranged in rows on the side surface of each cone. In alternative embodiments of the invention, teeth may be arranged in any number of rows on each of the cones, or the teeth may not be arranged in rows, but instead placed in a different configuration about the surface of the cone, such as a staggered arrangement. It should be understood that the invention is not limited to the particular arrangement of the teeth shown in FIGS. 4–7, but rather the teeth may be arranged in any suitable manner as determined by the bit designer without departing from the spirit of the invention. Further, although a roller cone bit having three cones as shown for this embodiment, it should be understood that the invention is not limited to bits having three roller cones. The invention only requires that the bit have a plurality of cones, thus, at least two roller cones. In preferred embodiments, the drill bit comprises at least three roller cones.

Additionally, using a method for simulating a roller cone bit drilling an earth formation, the drilling performance of a bit in accordance with this embodiment of the invention was analyzed and found to provide several drilling characteristics which represent improvements over prior art roller cone drill bits. One such simulation method, for example, is described in a patent application filed in the United States on Mar. 13, 2000, entitled "Method for Simulating the Drilling of Roller Cone Drill Bits and its Application to Roller Cone Drill Bit Design and Performance", Ser. No. 09/524,088, assigned to the assignee of this invention. While this preferred embodiment was found to provide improved drilling characteristics, the invention - is not limited to providing improved drilling characteristics, but instead is directed to an equalized distribution of teeth between the cones, and more preferably between three-cone bits with an intermeshing tooth pattern between the cones.

The invention has been described with respect to specific embodiments. It will be apparent to those skilled in the art that the foregoing description is only an example of the invention, and that other embodiments of the invention can be devised which will not depart from the spirit of the invention as disclosed herein. Therefore, the scope of the invention is intended to be limited only by the scope of the claims that follow.

What is claimed is:

1. A roller cone drill bit, comprising:

a bit body;

a plurality of roller cones attached to the bit body and able to rotate with respect to the bit body; and a plurality of teeth arranged on each of the cones so that teeth on adjacent cones intermesh between the adjacent cones, and a number of teeth on each of the cones differs by two or fewer from the number on each of the other of the cones.

2. The drill bit according to claim 1, wherein the plurality of roller cones comprises at least three cones.

3. The drill bit according to claim 2, wherein the at least three cones comprise a first cone, a second cone, and a third cone, and the number of teeth disposed on each of the cones is 17, 16, and 18, respectively.

4. The drill bit according to claim 1, wherein the teeth further comprise hardface coating.

5. A roller cone drill bit, comprising:

a bit body;

three roller cones attached to the bit body and able to rotate with respect to the bit body; and a plurality of teeth arranged on each of the cones so that teeth on adjacent cones intermesh between the adjacent cones, and a number of teeth on each of the cones differs by two or fewer from the number on each of the other of the cones.

6. The drill bit according to claim 5, wherein the number of teeth disposed on each of the cones is 17, 16, and 18, respectively.

7. The drill bit according to claim 5, wherein the teeth further comprise hardface coating.

* * * * *